US005101105A

United States Patent [19]

Fenselau et al.

[11] Patent Number: 5,101,105

[45] Date of Patent: Mar. 31, 1992

[54] NEUTRALIZATION/CHEMICAL REIONIZATION TANDEM MASS SPECTROMETRY METHOD AND APPARATUS THEREFOR

[75] Inventors: Catherine Fenselau; Robert J. Cotter, both of Baltimore, Md.

[73] Assignees: Univeristy of Maryland, Baltimore County; John Hopkins University, both of Baltimore, Md.

[21] Appl. No.: 608,435

[22] Filed: Nov. 2, 1990

[51] Int. Cl.[5] ..... H01J 49/26

[52] U.S. Cl. ..... 250/281; 250/282

[58] Field of Search ..... 250/281, 282

[56] References Cited

U.S. PATENT DOCUMENTS

| | | | |
|---|---|---|---|
| 4,851,669 | 7/1987 | Aberth | 250/281 |
| 4,960,991 | 10/1990 | Goodley et al. | 250/281 |
| 4,988,869 | 1/1991 | Aberth | 250/281 |

FOREIGN PATENT DOCUMENTS

| | | | |
|---|---|---|---|
| 61-93544 | 5/1986 | Japan | 250/281 |
| 2-7343 | 1/1990 | Japan | 250/281 |

OTHER PUBLICATIONS

Arimura, M., "Assembly of Tandem Mass Spectrometer", Institute of Chemistry, College of General Education, Osaka University, vol. 23, No. 1-2 (1974), pp. 39-44.

*Primary Examiner*—Jack I. Berman
*Assistant Examiner*—Jacob M. Eisenberg
*Attorney, Agent, or Firm*—Sughrue, Mion, Zinn, Macpeak & Seas

[57] ABSTRACT

A mass spectrometer system including a device for supplying a protonated ion species; a single chamber having an entrance and an exit slit, the chamber receiving the supplied protonated ion and transmitting a reprotonated ion through the exit slit; a device for supplying a predetermined reagent gas within the chamber; a device for supplying an electron beam in said chamber such that the electron beam reacts with the supplied predetermined reagent gas to provide neutral reagent gas and protonated reagent gas within the chamber, the supplied ion species reacting with the neutral reagent gas to neutralize the ion species, thereby providing neutral species within the chamber, the neutral species reacting with the protonated reagent gas to provide reionized species within the chamber; and a device, coupled to the exit slit of the chamber, for extracting the reionized species.

15 Claims, 2 Drawing Sheets

NEUTRALIZATION/CHEMICAL REIONIZATION TANDEM MASS SPECTROMETRY METHOD AND APPARATUS THEREFOR

FIELD OF THE INVENTION

The present invention relates to an apparatus and method for tandem mass spectrometry. The apparatus and method uses proton transfer reactions to provide first neutralization and then reionization of a primary ion molecule.

BACKGROUND OF THE INVENTION

Mass spectrometry is used to identify unknown compounds, to qualify known materials, and to clarify the structural and chemical properties of molecules. Mass spectrometers can accomplish these functions with very minute quantities of sample material, e.g., less than picogram amounts, and at very low concentrations in chemically complex mixtures, e.g., one part in a trillion.

Mass spectrometry has been used, inter alia, to detect and identify steroid use by athletes; for real time breath monitoring of patients by anesthesiologists during surgery; to determine the composition of molecular species found in space; to locate oil deposits by measuring petroleum precursors in rock; to detect dioxins in contaminated fish; and to determine gene damage from environmental causes.

FIG. 1 shows a conventional mass spectrometer which includes an ionization source 1, an ion analyzer 2, an ion detector 3 and a data system 4. A sample is provided to the ionization source 1 via an inlet. The sample may be a solid, liquid, or vapor. However, to perform efficiently the functions of ionization, ion analysis and ion detection, the mass spectrometer usually requires the sample to be a gas, and the ionization source 1 to be a vacuum chamber. When introducing pure solids into the ionization source 1, the sample is simply placed on the tip of a rod that is inserted into the vacuum chamber 1 through a vacuum-tight seal. The introduced sample is then evaporated or sublimed into the gas phase, usually by applying heat. Gases and liquids can be introduced into the ionization source 1 through inlets with controlled flow.

After ionization, the ions are sorted in the mass analyzer 2 according to their mass-to-charge (m/z) ratios, and then are collected by the ion detector 3. In the ion detector 3, the ions generate an electrical signal that is proportional to the number of detected ions. The generated electrical signals are supplied to the data system 4 which records these electrical signals and then converts them into a mass spectrum, i.e., a graph of ion abundance vs. mass-to-charge ratio. The ions and their respective abundances serve to establish the molecular weight and structure of the compound being mass analyzed.

FIG. 2 shows the ionization source 1 implemented by a technique known as Electron Ionization (EI). In this technique, ions are generated in the ionization source 1 by bombarding the introduced gaseous molecules (sample) with a beam of electrons from a filament 5 at e.g., 70 eV. Since the energy of the bombarding electrons is much greater than the bonds which hold the molecule together, the high energy electrons interact with the gaseous molecule sample. As a result, ionization occurs, bonds are broken and ion fragments are formed. In the resulting mixture, positive ions are propelled into the analyzer 2 by applying a voltage on the repeller 6, and focused by voltages applied to the lens system 7. Negative ions and electrons are attracted to the positively charged cathode or electron trap 8. Finally, the resulting neutral molecules and fragments that are not ionized are pumped away.

While EI is commonly used for those molecules that can be vaporized, electron ionization with electrons accelerated through a potential of 70 volts is a highly energetic or "hard" process which may lead to extensive fragmentation that leaves very little or no trace of a molecular ion. In the absence of a molecular ion, molecular weight and structure are not easily determined. Further, relatively large molecules, such as complex proteins, require a significant amount of energy to induce fragmentation using EI. These problems have led to the development of lower energy ("soft") ionization techniques.

One such lower energy ionization technique is known as Chemical Ionization ("CI"). In contrast to electron ionization, CI produces ions by a relatively gentle process of proton transfer from an ionized reagent gas such as methane. Abundant protonated molecules generally result.

For example, the mass spectrum of ephedrine shows a fragment ion at m/z 58 and no molecular ion at m/z 165 under electron ionization conditions. However, under chemical ionization conditions, the mass spectrum shows a fragment ion at m/z 58 as in the EI, shows an abundant protonated fragment ion at m/z 148 which corresponds to a loss of water (18 mass units), and also shows an abundant protonated molecule at m/z 166. Thus, using chemical ionization, the fragment ion at m/z 58 and the molecular ion at m/z 166 can be detected.

As shown in FIG. 1, the ion analyzer 2 is coupled to the output of ionization source 1. In general, the ion analyzer serves to sort the ions from ionization source 1 according to their mass-to-charge ratios or a related property. Presently, there are three widely-used ion analyzers, namely, magnetic and electric sectors, quadrupoles, and ion traps.

Sector mass spectrometers use combinations of magnetic and electric fields to sort the ions. A common configuration for a sector instrument is the so-called Nier-Johnson geometry. In this sector instrument, ions of larger mass have trajectories of larger radius than ions of smaller mass. Ions of different mass-to-charge ratio are focused at a detector by varying the magnetic strength. This combination of electrostatic and magnetic analyzers provide mass resolution high enough to resolve ions of the same nominal mass, but different chemical formula, such as $N_2$ and CO at m/z 28.

Another type of mass analyzer is the so-called quadrupole mass filter and consists of four poles or rods. In this device, mass sorting depends on ion motion resulting from dc and radio frequency (rf) electric fields. Quadrupole mass spectrometers provide lower resolution than do sector mass spectrometers, but are more easily interfaced to various inlet systems.

The ion trap mass spectrometer operates on a principle similar to the quadrupole mass spectrometer. However, rather than allowing ions to pass therethrough, the ion trap is able to store all ions for subsequent experiments. The ion trap mass spectrometer uses a field that is generated by a sandwich geometry including a ring electrode in the middle and caps on each end. The ion trap serves to trap ions of a selected range of mass-to-charge ratios in the space bound by the electrodes. A mass spectrum is produced by varying the electric field to eject sequentially ions of increasing mass-to-charge ratio for detection.

In the past, mass spectrometric methods were restricted to relatively small, volatile molecules. However, with the development of ionization methods including Fast Atom Bombardment (FAB), plasma desorption and laser desorption, mass analysis can now be conducted on large and volatile molecules. Specifically, these techniques have been successful in the production of intact large molecular ions. Accordingly, much effort has been employed to induce the fragmentation of these large molecular ions so as to improve the detailed information necessary for characterizing their molecular structures.

The primary means for accomplishing this task has been the introduction of tandem mass spectrometers or Mass Spectrometry/Mass Spectrometry (MS/MS) in which the molecular ion is mass selected by a first mass spectrometer (MS1), and then the selected molecular ion is fragmented with the resulting products analyzed by a second mass spectrometer (MS2) which is scanned to produce a product ion spectrum. The major advantage of MS/MS analysis is the ability to select the molecular ion of a single analyte from a mixture and obtain its mass spectrum.

When Fast Atom Bombardment (FAB) is used as the ionization technique, the normal mass spectra are characterized by an abundance of peaks arising from the liquid matrix, adduct ions, and a general peak-to-every-mass background. In many cases, several molecular ion species are produced. Selection of a single molecular ion species in an MS/MS scheme produces a mass spectrum whose peaks are unambiguously attributable to the analyte and for which the S/N ratio relative to the background ions is considerably improved.

FIG. 3 shows the basic scheme for a tandem mass spectrometer or MS/MS system. In the most common arrangement, a collision chamber containing an inert gas (usually helium) is placed between the two mass spectrometers. Ions emerging from MS1 collide with neutral inert gas atoms and are fragmented by a process known as collision induced dissociation (CID). These fragment (or product) ions are then mass analyzed by MS2. Because this process (CID) becomes less effective for large molecular ions, several alternative schemes have been developed including surface induced dissociation (SID), electron induced dissociation (EID) and photodissociation.

An additional, but not widely, used technique is known as neutralization/reionization mass spectrometry (NRMS). The basic scheme for this technique, utilized on a tandem mass spectrometer or MS/MS system, is shown in FIG. 4.

In this case, a mass-selected high energy ion beam from a first mass spectrometer MS1 is neutralized by collisions with a metal vapor in a first collision cell C1, and then reionized through collisions with a second reagent gas, such as $O_2$, in a second collision chamber C2. The reionized molecule is then supplied to the second mass spectrometer for mass analysis.

In the system shown in FIG. 4, collisions with the vaporized metals in the first collision cell C1 favor charge exchange over collision-induced dissociation (CID). Reionization by collisions with $O_2$ occurs in the second chamber, produces fragment ions. Both charge transfer processes, i.e., neutralization and reionization, take place at high kinetic energy and involve electron transfer. In the first collision cell C1, an electron is transferred from the metal vapor, such as a Hg vapor, to the primary molecule, thereby neutralizing the primary molecule. The thus neutralized primary molecule is then supplied to the second collision cell C2 in which an electron transfer process again occurs, this time from the neutralized molecule to the $O_2$ vapor, thereby reionizing the primary molecule and at the same time producing fragment ions. The resulting ions are supplied from collision cell C2 to the second mass spectrometer for analysis by scanning in the B/E mode or with an electric sector (kinetic energy analyzer).

In FIG. 4, each of the first C1 and second C2 collision cells is a low pressure cell operating at a pressure such that the reagent gas is maintained at a pressure between 1 and 5 mTorr. Both processes, i.e., neutralization and reionization, take place at a high kinetic energy of approximately 4–5 keV.

A neutralization/reionization scheme involving charge exchange reactions has several disadvantages that are addressed by the proposed invention. Specifically, the system is relatively complex requiring two separate collision cells each employing a different reagent gas. The system also requires the neutralization and reionization processes to take place at relatively high kinetic energies. It is difficult to achieve such energies with large mass molecules. Finally, it does not address the fact that molecular ions produced by fast atom bombardment and other "soft" ionization techniques are generally even-electron protonated species that could more easily be neutralized by deprotonation.

SUMMARY OF THE INVENTION

An object of the present invention is to provide a tandem mass spectrometer (MS/MS) system which is relatively simple is design.

It is another object of the invention to provide a tandem mass spectrometer in which collisions for neutralization and reionization occur at relatively low energies.

These and other objects are achieved according to the present invention which provides a tandem mass spectrometer system including:

a device for supplying protonated ion species;

a single chamber having an entrance and an exit slit, the chamber receiving the supplied protonated ion and then transmitting the reprotonated ion through the exit slit;

a device for supplying predetermined reagent ions within the chamber;

a device for supplying an electron beam in the chamber such that the electron beam reacts with the supplied predetermined reagent ions to provide neutral reagent gas and protonated reagent ions within the chamber.

According to the invention, the supplied ion species reacts with the neutral reagent gas to neutralize the ions species, thereby providing neutral species within said chamber. Further, the neutral species react with the protonated reagent ions to provide reionized species within the chamber. The reionized species are then extracted from the chamber for mass analysis. This method may be termed neutralization/chemical reionization and is implemented by a combination of deceleration and focusing lenses, a combination collision chamber and chemical ionization source, and a suitable set of extraction and focusing lenses.

PREFERRED EMBODIMENT OF THE INVENTION

Figure 1:
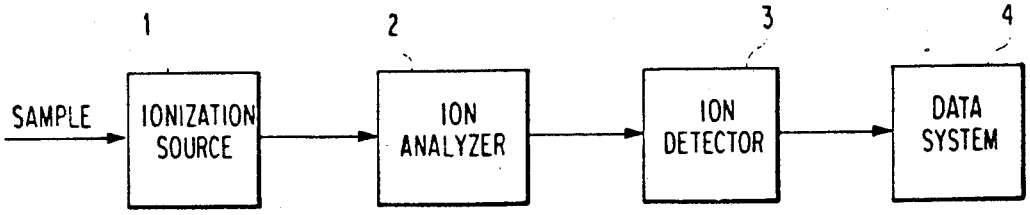
FIG. 1 PRIOR ART
FIG. 1 is a block diagram showing a conventional mass spectrometer.
Figure 2:
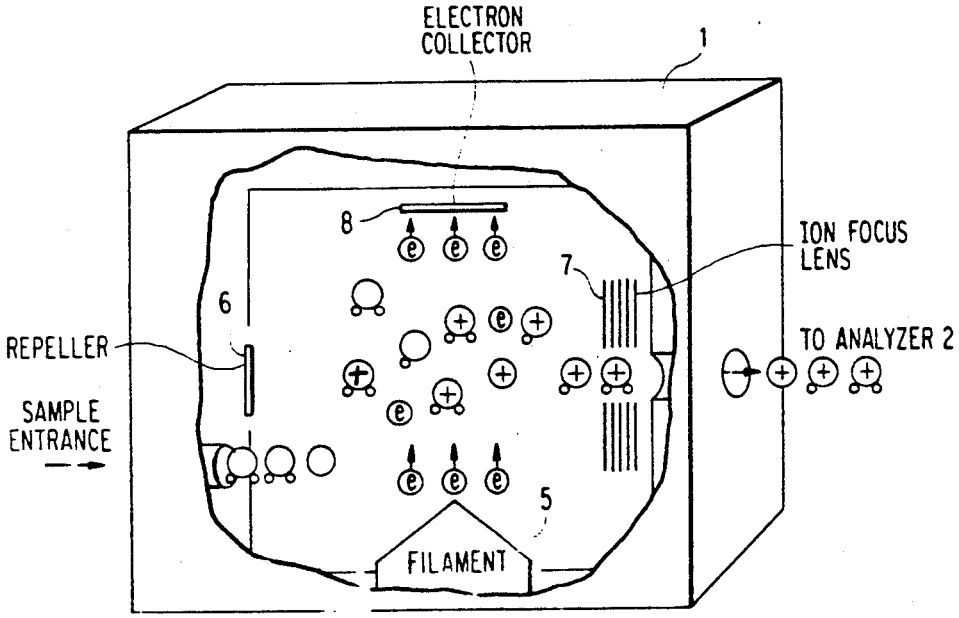
FIG. 2 PRIOR ART
FIG. 2 is a block diagram showing the ionization source of FIG. 1 in greater detail.
Figure 3:
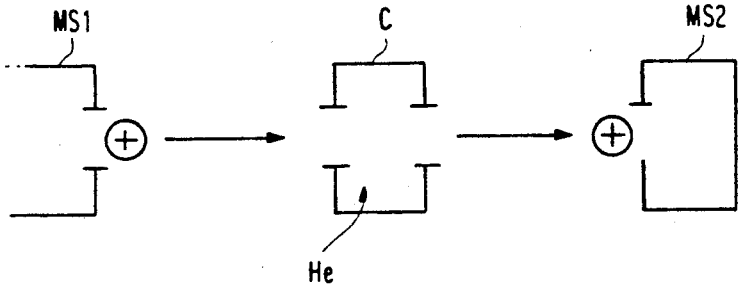
FIG. 3 PRIOR ART
FIG. 3 is a block diagram showing a known tandem mass spectrometer system utilizing a collision chamber.
Figure 4:
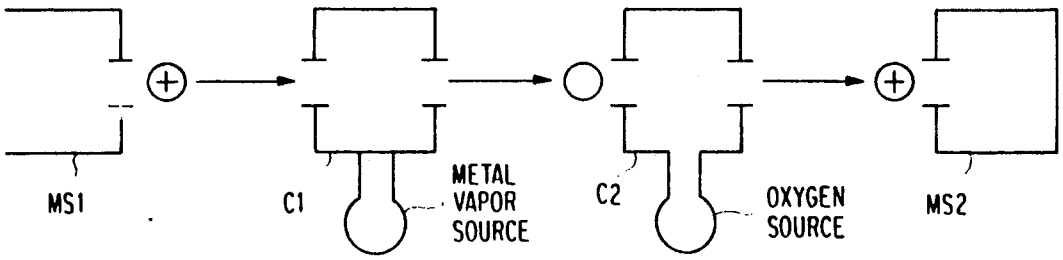
FIG. 4 PRIOR ART
FIG. 4 is a block diagram showing a neutralization/reionization tandem mass spectrometer system.
Figure 5:
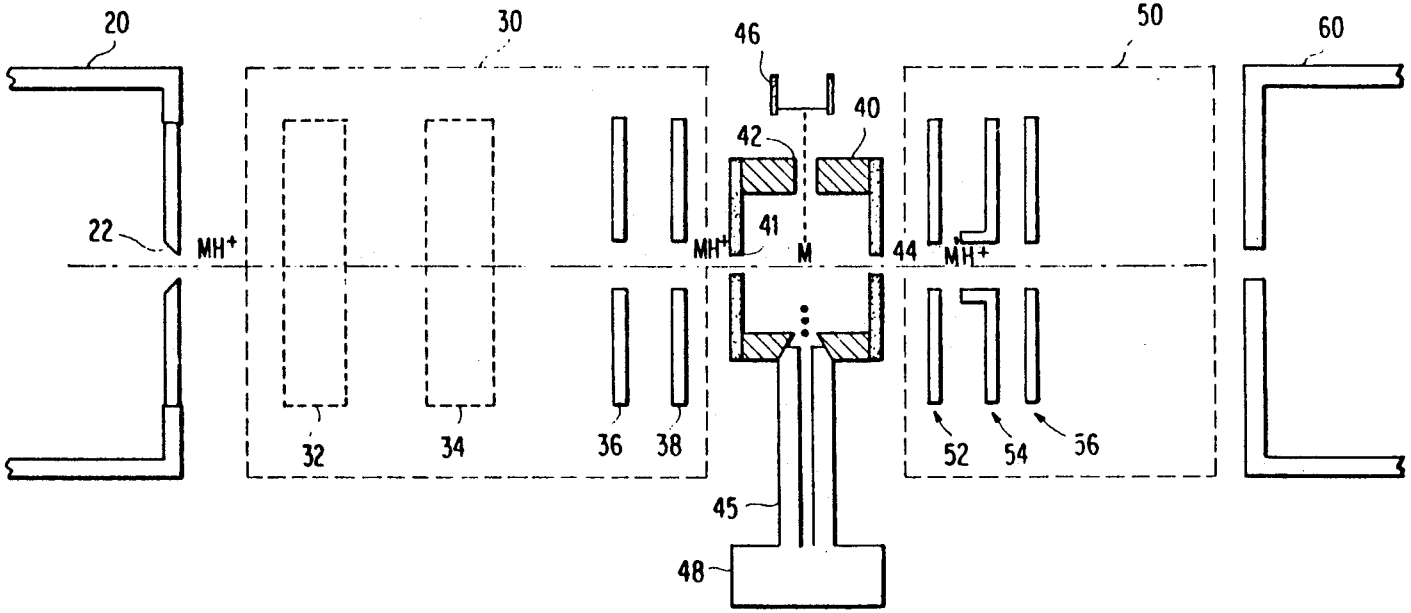
FIG. 5 is a block diagram of the tandem mass spectrometer according to the present invention.

FIG. 5 shows the neutralization/chemical reionization system according to the present invention. As shown in FIG. 5, the system includes a first mass spectrometer 20, a focusing system 30, a neutralization/-chemical reionization source chamber 40, an electron beam source 46 coupled to the chamber 40, a reagent gas source 48 also coupled to the chamber 40, a chamber exit coupling system 50 and a second mass spectrometer 60.

The first mass spectrometer 20 serves to select protonated molecular ions MH+ of a given mass. The selected molecular ions MH+ are not scanned in mass spectrometer 20. Rather, the first mass spectrometer 20 provides the selected molecular ions MH+ as a primary ion beam from the exit slit 22 of mass spectrometer 20. The exit slit 22 is generally at ground potential and the primary ion beam M+ emerges from the exit slit 22 at a full accelerating energy of between approximately 8 and 10 KeV.

The primary ion beam MH+ from mass spectrometer 20 is directed to focusing system 30 which includes Y and Z direction lens 32 and 34, respectively. The lens 32 and 34 may be simple deflectors, beam steering plates or quadrupole/hexapole lenses. The focusing system 30 further includes focusing lenses 36 and 38 which may be provided in an Einzel configuration. Specifically, the first lens 36 is set at a potential which is equal to that of the neutralization/chemical reionization chamber 40 and defines the energy of the primary ion beam MH+ at the time it enters chamber 40. The second lens 38 is disposed between the first lens 36 and chamber 40, and is adjusted to provide optimal focusing of the ion beam MH+ into the entrance slit 41 of chamber 40.

The neutralization/chemical ionization chamber 40 is a high pressure chamber operating at pressures sufficient to maintain the reagent gas at pressures between 0.1 and 5 Torr, and at a temperature of about 180 degrees C. The chamber 40 may be, for example, cubic or cylindrical in shape. The chamber 40 is electrically insulated from ground to permit use at potentials approaching that of the ionization source contained in mass spectrometer 20. Specifically, chamber 40 can be set to an electrical potential, e.g., 6 kilovolts, such that the relative energy in the center-of-mass frame between the sample ions and the reagent gas exceeds the endothermicity of the proton transfer reaction to the reagent gas.

As shown in FIG. 5, chamber 40 includes four slits 41-44. Slit 41 receives the primary ion beam MH+ from the focusing system 30, as discussed above. Slit 41 is preferably replaceable to permit different sizes to be used and to enable replacement as the slit deteriorates under long term bombardment of the primary ion beam MH+. The electron beam source 46 is disposed in line with slit 42 so as to allow the introduction of an electron beam into chamber 40. The reagent gas source 48 is coupled to chamber 40 via a line 45 and inlet 43. The line 45 is constructed from an electrically insulating material to enable the flow of the reagent gas into chamber 40 placed at the high voltage.

As indicated above, chamber 40 maintains the reagent gas at pressures between 0.1 and 4 Torr. Accordingly, each of the slits 41-44 is small enough so that this high pressure can be maintained in chamber 40.

Chamber 40 is a neutralization/chemical reionization chamber. That is, both neutralization and chemical reionization of the primary ion beam MH+ occur within chamber 40. First, neutralization of the primary ion molecule MH+ occurs, and then the thus neutralized molecule MH+ is reionized before it exits chamber 40 via exit slit 44. During the neutralization and chemical reionization processes the electron beam source 46 is turned ON so as to provide chamber 40 with a mixture of both neutral reagent gas molecules and protonated reagent ions for these two processes. The electron source 46 is biased to approximately 200 volts below the potential of the chamber 40.

The neutralization reaction is an endothermic (i.e., requires energy) transfer of a proton from the primary ion molecule MH+ to the neutral reagent gas. In the case where the primary ion molecule is a protonated peptide produced by fast atom bombardment, ammonia is a suitable reagent gas. Specifically, protonated peptide molecules enter chamber 40 with kinetic energies which initially are much larger than that required for efficient proton transfer to the reagent gas particles. The primary ion beam MH+ from lens system 30 will undergo multiple collisions with the reagent gas. The initial collisions will be at a relatively high kinetic energy, and may induce fragmentation of the ions MH+. Subsequent collisions will reduce the energy of the product ions and neutrals. When the relative energy of the ions reach a value just over the endothermicity of proton transfer, the ions will be neutralized. Specifically, when their kinetic energies are sufficiently low, the primary ion molecules MH+ will react with the neutral reagent gas to transfer a proton.

In protonated peptides, the protons are primarily localized at the amide bonds. Such ions react with the ammonia in chamber 40, where the neutralization reaction:

$$MH^+ + NH_3 — M + NH_4^+ \quad (1)$$

occurs at a relative energy in the center-of-mass frame, $E_{cm}$:

$$E_{cm} = (E_{lab} \times M_n)/(M_{ion} + M_n); \quad (2)$$

wherein:

$M_n$ = mass of the neutral reagent gas $M_{ion}$ = mass of the molecular ion whose threshold can be estimated from the reaction:

$$NH_4^+ + CH_3CONH_3 — NH_3 + CH_3CONH_3^+ \quad (3)$$

which is exothermic (delta H = −2.2 Kcal/mole = 0.10 ev).

Since the mass of the ion selected in mass spectrometer 20 is known, it is a simple task to choose a collision energy, (corresponding to about 0.1 ev above threshold in the center of mass frame) which will optimize the neutralization reaction.

During the reionization stage, the protonated reagent gas produced by the electron beam will transfer a proton to the neutralized primary molecules M and to the neutral fragments (formed in the initial high energy collisions) such that all species are reionized. This occurs because the neutralized primary molecules M and the neutral fragments will continue to lose kinetic energy through further collisions within chamber 40, and will ultimately encounter the protonated reagent gas ion produced by the electron beam from source 46. At this point, the endothermic deprotonation reaction will be reversed, and the primary neutral molecule and neutral fragments will be reprotonated by an exothermic reaction. During reionization, the neutral molecule may again undergo fragmentation. The reionization process causes the neutralized molecule, the fragments produced during reionization, as well as the fragments produced during the initial high energy collisions of the primary ion molecules MH+ all to be ionized, and these ionized molecules and fragments exit chamber 40 via slit 44.

The neutralization/chemical reaction process presented above is also discussed in the article entitled "Endothermic Ion-Molecule Reactions: Strategies for Tandem Mass Spectrometric Structural Analysis of Large Biomolecules", *Analytical Chemistry*, Vol. 62, No. 2, Jan. 15, 1990, pages 125-129, by the inventors.

The molecular and fragment ions exiting chamber 40 are then directed to the exit coupling system 50 which includes a series of extraction 52, beam centering 54, and focusing and accelerating lenses 56, as is used with conventional ionization sources. The exited molecular and fragment ions are supplied to the second mass spectrometer 60 via the exit coupling system 50. During the reionization process, all the resulting ions reduce to an energy of less than 1 ev. The ions are subsequently accelerated to the same energy by the acceleration and focusing lenses 56 so that the mass analysis of the molecular and fragment ions conducted in the second mass spectrometer 60 is accomplished by quadratic scans of the magnetic field.

As discussed above, the neutralization/chemical reionization tandem mass spectrometry system according to the invention uses proton transfer reactions. The neutralization reaction is an endothermic transfer of a proton from the protonated molecule (e.g., peptide) to a reagent gas (e.g., ammonia). As the kinetic energies of the neutralized molecules are further reduced by additional collisions within the chamber, they are reprotonated by the reverse exothermic reaction.

The system according to the invention has the advantages that the neutral and reionization reactions can be conducted in a single chamber with a single reagent gas, that the neutralization and reionization reactions occur at relatively low energies and are compatible with protonated species produced by soft ionization techniques (e.g., FAB), and that fragmentation is readily induced from the initial high energy collisions of the primary ion molecules from the first mass spectrometer, and from the reionization reaction.

Having described an illustrative embodiment of the invention with reference to the accompanying drawings, it is to be understood that the invention is not limited to that precise embodiment, and that many changes and modifications can be effected by one skilled in the art without departing from the scope or spirit of the invention, as defined in the appended claims. For example, while the invention was described in connection with tandem mass spectrometry or MS/MS, the invention can be utilized in other arrangements.

What is claimed is:

1. A mass spectrometer system comprising:

means for supplying an ion species;

a single chamber having an entrance and an exit slit, said chamber receiving said supplied protonated ions and delivering protonated ions through said exit slit;

means for supplying a predetermined reagent gas within said chamber;

means for supplying an electron beam in said chamber such that said electron beam reacts with said supplied predetermined reagent gas to provide neutral reagent gas and protonated reagent ions within said chamber, said supplied ion species reacting with said neutral reagent gas to neutralize said ion species, thereby providing neutral species within said chamber, and said neutral species reacting with said protonated reagent ions to provide reionized species within said chamber; and means, coupled to the exit slit of said chamber, for extracting said reionized species.

2. The mass spectrometer system as defined in claim 1, wherein said means for supplying an ion species comprises a first mass spectrometer.

3. The mass spectrometer system as defined in claim 1, wherein said single chamber is electrically insulated from ground and is set at an electrical potential such that a relative energy in a center-of-mass frame between said ion species and said neutral reagent gas exceeds the endothermicity of a proton transfer reaction from the ion species to the neutral reagent gas.

4. The mass spectrometer system as defined in claim 1, wherein said means for supplying a predetermined reagent gas comprises a reagent gas source means and a tube connected between said reagent gas source means and said single chamber, said tube being made of an electrically insulating material.

5. The mass spectrometer system as defined in claim 1, wherein said means for extracting reionized species comprises extraction lens disposed adjacent said exit slit, accelerating and focusing lens, and beam centering lens disposed between said extraction lens and said accelerating and focusing lens.

6. The mass spectrometer system as defined in claim 1, wherein said means for supplying an electron beam comprises an electron beam source biased to approximately 200 volts below the potential of said chamber.

7. The mass spectrometer system as defined in claim 1, further comprising lens means disposed between said chamber and said means for supplying the ion species, said lens means including a pair of lenses arranged in an Einzel configuration.

8. The mass spectrometer system as defined in claim 1, wherein said chamber contains a pressure which is sufficient to maintain said supplied reagent gas between 0.1 and 5 Torr.

9. The mass spectrometer system as defined in claim 1, wherein said means for supplying the ion species supplies said ion species at an accelerating energy of between 8 and 10 Kev.

10. The mass spectrometer system as defined in claim 2, further comprising a second mass spectrometer for mass analyzing the reionized species.

11. A method for a mass spectrometer system including a single chamber, said method comprising the steps of:

supplying an ion species to said chamber;

supplying a predetermined reagent gas to said chamber;

supplying an electron beam to said chamber such that said electron beam reacts with said supplied predetermined reagent gas to provide neutral reagent gas and protonated reagent gas within said chamber, said supplied ion species reacting with said neutral reagent gas to neutralize said ions species, thereby providing neutral species within said chamber, and said neutral species reacting with said protonated reagent gas to provide reionized species within said chamber; and extracting said reionized species.

12. The method as defined in claim 11, further comprising the step of setting said chamber at an electrical potential such that a relative energy in a center-of-mass frame between said ion species and said neutral reagent gas exceeds the endothermicity of a proton transfer reaction from the ion species to the neutral reagent gas.

13. The method as defined in claim 11, further comprising the step of providing within said chamber a pressure which is sufficient to maintain said supplied reagent gas between 1 and 5 Torr.

14. The method as defined in claim 11, wherein said step of supplying the ion species includes supplying said ion species at an accelerating energy of between 8 and 10 Kev.

15. The method as defined in claim 11, further comprising the step of analyzing the reionized species.

* * * * *